US008943728B2

(12) United States Patent
Ward et al.

(10) Patent No.: US 8,943,728 B2
(45) Date of Patent: Feb. 3, 2015

(54) FIXED STOCK WITH INTEGRAL STORAGE

(71) Applicants: Thomas Ward, Thorntin, CO (US); Michael T. Mayberry, Denver, CO (US); Brian L. Nakayama, Arvada, CO (US)

(72) Inventors: Thomas Ward, Thorntin, CO (US); Michael T. Mayberry, Denver, CO (US); Brian L. Nakayama, Arvada, CO (US)

(73) Assignee: Magpul Industries Corp., Erie, CO (US)

( * ) Notice: Subject to any disclaimer, the term of this patent is extended or adjusted under 35 U.S.C. 154(b) by 0 days.

(21) Appl. No.: 13/894,676

(22) Filed: May 15, 2013

(65) Prior Publication Data

US 2013/0305579 A1 Nov. 21, 2013

Related U.S. Application Data

(60) Provisional application No. 61/647,421, filed on May 15, 2012.

(51) Int. Cl.

| | |
|---|---|
| ***F41C 23/00*** | (2006.01) |
| ***F41C 23/22*** | (2006.01) |
| ***F41C 23/20*** | (2006.01) |

(52) U.S. Cl.

CPC ..... *F41C 23/22* (2013.01); *F41C 23/20* (2013.01)

USPC ..... 42/71.01

(58) Field of Classification Search

CPC ..... F41C 23/22; F41C 23/20

USPC ..... 42/71.01, 72, 73, 74, 75.03

See application file for complete search history.

(56) References Cited

U.S. PATENT DOCUMENTS

| | | | | | |
|---|---|---|---|---|---|
| 939,707 | A | * | 11/1909 | Kennedy | 42/71.01 |
| 1,266,024 | A | * | 5/1918 | Kennedy | 42/71.01 |
| 2,187,640 | A | * | 1/1940 | Bost | 42/75.03 |
| 2,196,852 | A | | 4/1940 | Browning | |
| 2,763,951 | A | * | 9/1956 | Harvey | 42/71.01 |
| 3,388,494 | A | * | 6/1968 | Kimball | 42/74 |
| 3,618,248 | A | * | 11/1971 | Into et al. | 42/71.01 |
| 4,512,101 | A | * | 4/1985 | Waterman, Jr. | 42/71.01 |
| 4,654,993 | A | * | 4/1987 | Atchisson | 42/71.01 |
| 5,173,564 | A | * | 12/1992 | Hammond, Jr. | 42/75.03 |
| 6,543,172 | B1 | * | 4/2003 | Armstrong | 42/71.01 |
| 6,655,068 | B2 | * | 12/2003 | Murello et al. | 42/74 |
| 6,779,289 | B2 | * | 8/2004 | Kay | 42/75.03 |
| 6,886,286 | B2 | | 5/2005 | Dowding | |
| 6,889,463 | B2 | | 5/2005 | Orth | |
| 7,162,822 | B1 | * | 1/2007 | Heayn et al. | 42/73 |
| 7,493,718 | B2 | * | 2/2009 | Gorzen | 42/74 |
| 7,726,060 | B1 | | 6/2010 | Jones | |
| 7,748,154 | B2 | * | 7/2010 | Moretti | 42/75.03 |
| 7,823,315 | B2 | | 11/2010 | Webber et al. | |
| 8,341,868 | B2 | * | 1/2013 | Zusman | 42/73 |
| 8,387,298 | B2 | * | 3/2013 | Kincel | 42/74 |
| 8,555,541 | B2 | * | 10/2013 | Ingram | 42/71.01 |
| 2005/0183315 | A1 | * | 8/2005 | Davis | 42/71.01 |
| 2005/0188592 | A1 | | 9/2005 | Spinner et al. | |
| 2006/0010749 | A1 | * | 1/2006 | Kincel | 42/71.01 |
| 2007/0089347 | A1 | | 4/2007 | Webber et al. | |
| 2007/0261284 | A1 | * | 11/2007 | Keng | 42/73 |

(Continued)

*Primary Examiner* — Michelle R Clement

(74) *Attorney, Agent, or Firm* — Geoffrey E. Dobbin; Dobbin IP Law P.C.

(57) ABSTRACT

The present invention is a fixed stock with integral storage that utilizes a cam plug inside the storage compartment to secure the stock to a firearm. In the preferred embodiment, the cam plug interfaces with the hind edge of the stock body and is therefore visible outside the stock, for a stronger and more secure hold.

2 Claims, 9 Drawing Sheets

(56) References Cited

U.S. PATENT DOCUMENTS

| | | | | |
|---|---|---|---|---|
| 2008/0005951 | A1* | 1/2008 | Gorzen | 42/14 |
| 2008/0236016 | A1* | 10/2008 | Fitzpatrick et al. | 42/71.01 |
| 2009/0178323 | A1* | 7/2009 | Fluhr et al. | 42/71.01 |
| 2009/0255161 | A1* | 10/2009 | Fitzpatrick et al. | 42/90 |
| 2010/0205846 | A1* | 8/2010 | Fitzpatrick et al. | 42/73 |
| 2010/0229444 | A1* | 9/2010 | Faifer | 42/1.06 |
| 2010/0275489 | A1* | 11/2010 | Cabahug et al. | 42/71.01 |
| 2011/0173863 | A1* | 7/2011 | Ingram | 42/73 |
| 2011/0192067 | A1* | 8/2011 | Troy | 42/73 |
| 2011/0283584 | A1* | 11/2011 | Walters | 42/73 |
| 2012/0000108 | A1* | 1/2012 | Zusman | 42/71.01 |
| 2012/0000109 | A1* | 1/2012 | Zusman | 42/71.01 |
| 2012/0023802 | A1* | 2/2012 | Vesligai | 42/71.01 |
| 2012/0137560 | A1* | 6/2012 | Denton et al. | 42/71.01 |
| 2012/0174455 | A1* | 7/2012 | Edelman et al. | 42/71.01 |
| 2012/0174456 | A1* | 7/2012 | DePierro et al. | 42/71.01 |
| 2012/0174457 | A1* | 7/2012 | Edelman | 42/72 |
| 2012/0260552 | A1* | 10/2012 | Vesligaj | 42/1.06 |
| 2013/0097911 | A1* | 4/2013 | Larue | 42/73 |
| 2014/0109453 | A1* | 4/2014 | Paquette | 42/73 |

* cited by examiner

FIXED STOCK WITH INTEGRAL STORAGE

CROSS-REFERENCES TO RELATED APPLICATIONS

This Application claims priority as a non-provisional perfection of U.S. Provisional Application No. 61/647,421, filed May 15, 2012 and incorporates the same by reference in its entirety herein.

FIELD OF THE INVENTION

The present invention relates to the field of firearms and more particularly relates to a fixed butt stock.

BACKGROUND OF THE INVENTION

Since the invention of the firearm, stocks have been used to manipulate and support the weapon for firing. Often, these stocks have been doubly used for the storage of small, useful items. Stocks have been created for various purposes, including stocks that are adjustable for length, collapsible, and stocks for precision shooting. Many of these special purpose stocks are regulated, so there is a need for fixed stocks, stocks that do not adjust, for civilian use. Like all stocks, the shape of a fixed stock is based on personal preference and, regardless of shape, ease of installation, compatibility with the host firearm, and other useful features, like item storage, are also concerns.

The present invention is a fixed butt stock for a long firearm, particularly a rifle having a receiver extension tube or similar structure. The stock features a simple slip-on geometry based on the size and shape of the receiver tube and a cam plug that is inserted into the back end of the stock. The back end is structured for a storage compartment and a door added to seal said compartment. The present invention represents a departure from the prior art in that the butt stock of the present invention allows for easy interface and connection to a given rifle or other firearm and simple attachment thereto by a cam feature residing within a contained and shielded, but easily accessible, storage compartment.

SUMMARY OF THE INVENTION

In view of the foregoing disadvantages inherent in the known types of firearm butt stocks, this invention provides an easily installed butt stock with integral storage. As such, the present invention's general purpose is to provide a new and improved butt stock that is easily manufactured for various types of firearms, easily installed and provides easily accessible storage for accessories.

To accomplish these objectives, the butt stock comprises a stock body that slides onto a firearm's receiver extension tube or similar structure. The stock body has an open chamber in its hind section. A cam plug is inserted within the open chamber and fastened to the rear of the receiver extension tube. It should be noted that, when installed, the cam plug forms a part of the exterior of the stock. The stock then is completed with a door that closes over the open chamber.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the fixed stock with integral storage is herein described. It should be noted that the articles "a", "an", and "the", as used in this specification, include plural referents unless the content clearly dictates otherwise.

Figure 1:
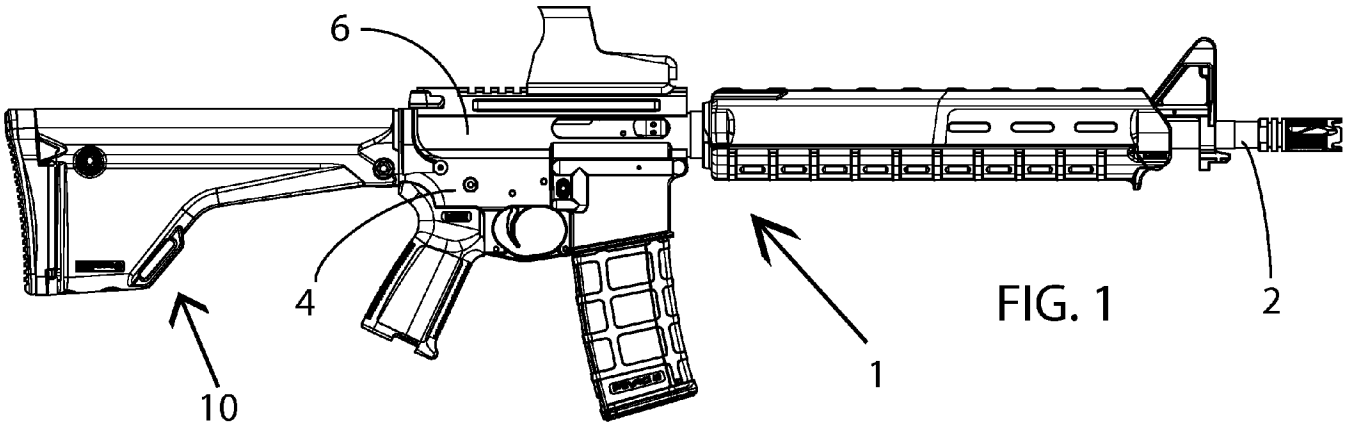
FIG. 1 is a right elevation of a firearm utilizing an embodiment of a fixed stock with integral storage according to the present invention.
Figure 2:
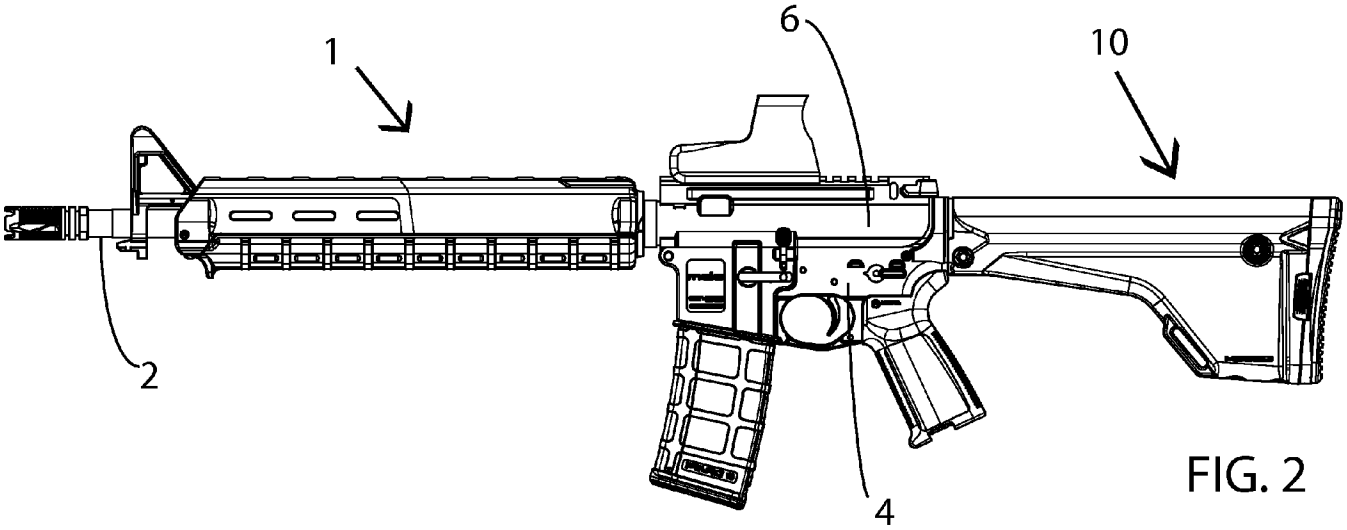
FIG. 2 is a left elevation of the firearm of FIG. 1.

With reference to FIGS. 1 and 2, the fixed stock with integral storage 10 is mounted upon the receiver extension tube of a firearm 1. The depicted firearm is a standard M16/AR15 firearm with lower receiver component 4 and an upper receiver component 6 which are united to form an entire receiver structure from which barrel 2 extends. The receiver contains the internal workings of the firearm 1 and also features a receiver extension tube 8 (FIG. 3), projecting in a direction opposite the barrel 2 and upon which the stock 10 resides. The invention will be described in this Application in relation to this type of firearm and known variants of this system; however, it is to be understood that the fixed stock may be adapted to other types of firearms with similar structures for use in mounting a stock. This would include AIR-SOFT rifles. The term "receiver extension tube" is defined to include equivalent structures in other firearm types and similar structures upon which stocks are mounted.

Figure 3:
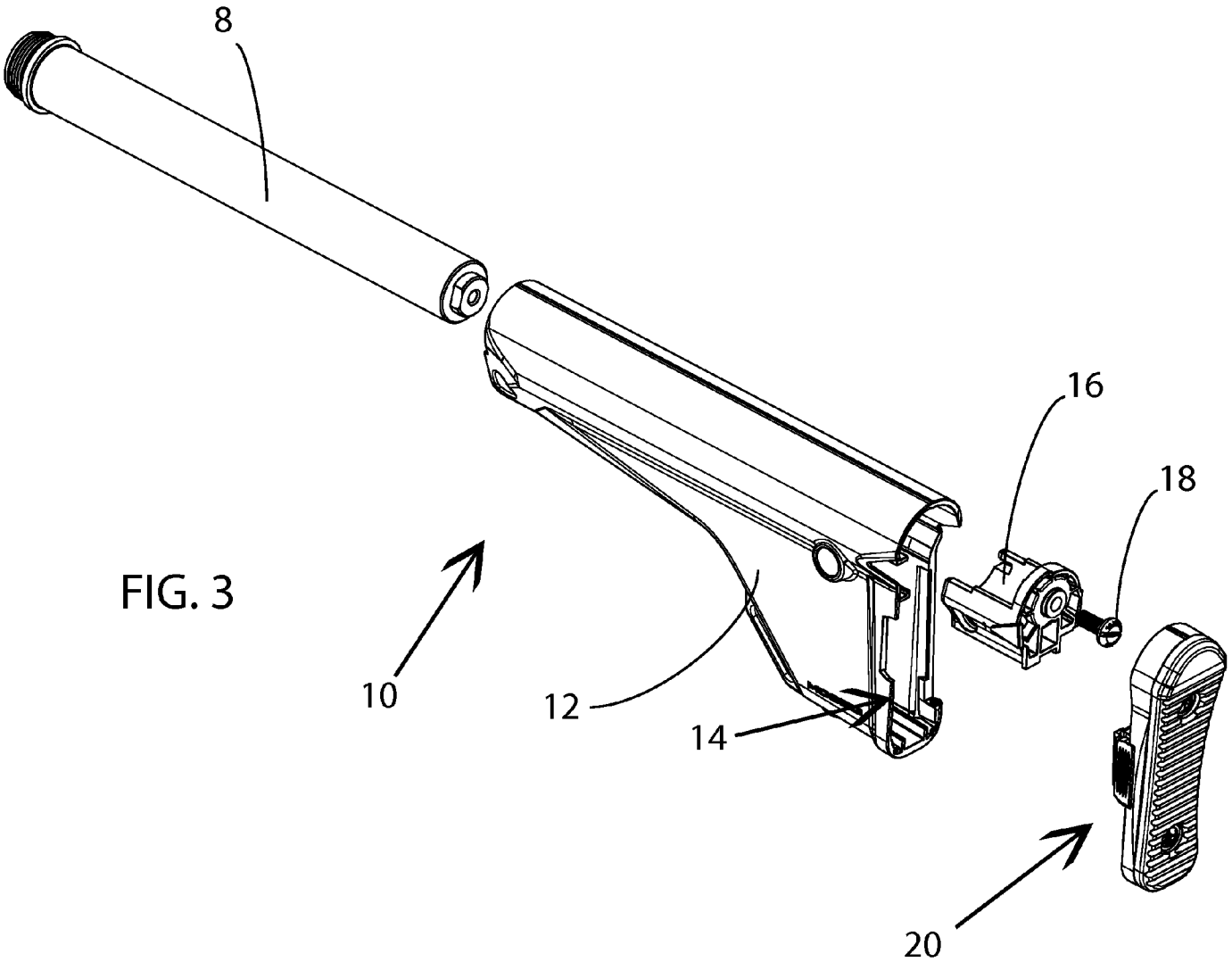
FIG. 3 is an exploded perspective view of the fixed stock used on the firearm of FIG. 1.

In reference to FIG. 3, the stock 10 is a relatively simple construction. A stock body 12 is provided. The stock body 12 may be of any shape or design with the following requirements: first it must fit over the receiver extension tube or otherwise interface with mounting structure in the firearm's stock mounting paradigm; second, the hind end terminates in a circumferential flange which at least partially defines a hollowed chamber and terminates with a rear edge 14. A cam plug 16 is also provided. The "cam plug" is superior to simpler bolt constructions. Where the shoulder of a bolt head may serve to secure pieces together by preventing one piece from sliding off of a bolt, a cam plug, as used in this Application, is a structure that not only holds two pieces together, but significantly interfaces with the surfaces and/or edges of at least one of the pieces joined. Cam plug 16 is designed to interface with the rear edge 14 and the chamber while also attaching to the mounting structure, in this case a receiver extension tube 8, by use of bolt 18. By interfacing with the rear edge 14 of the stock body 12, the cam plug 16 securely anchors and not only joins, but actually cams the stock body 12 between itself and the lower receiver 4 into a more secure mounted relationship than is seen in the prior art. This cam relationship, anchoring the edges 14 of the stock body 12 and filling a portion of the chamber, reduces rotational moments and wobble of the stock body 12 in relation to the lower receiver 4.

Figure 4:
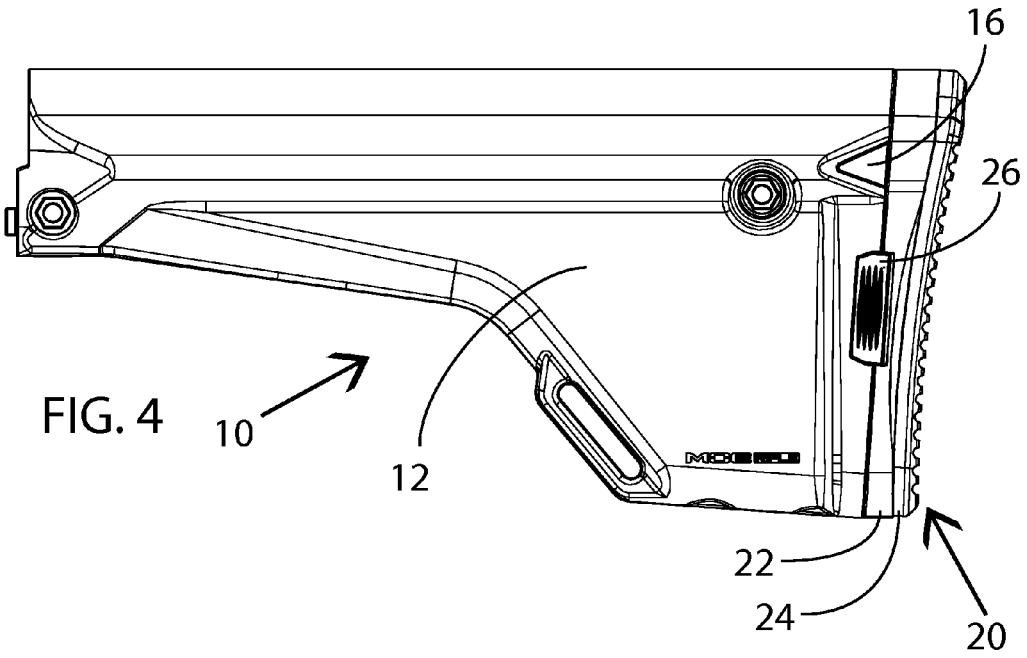
FIG. 4 is a right elevation of the fixed stock of FIG. 3.
Figure 5:
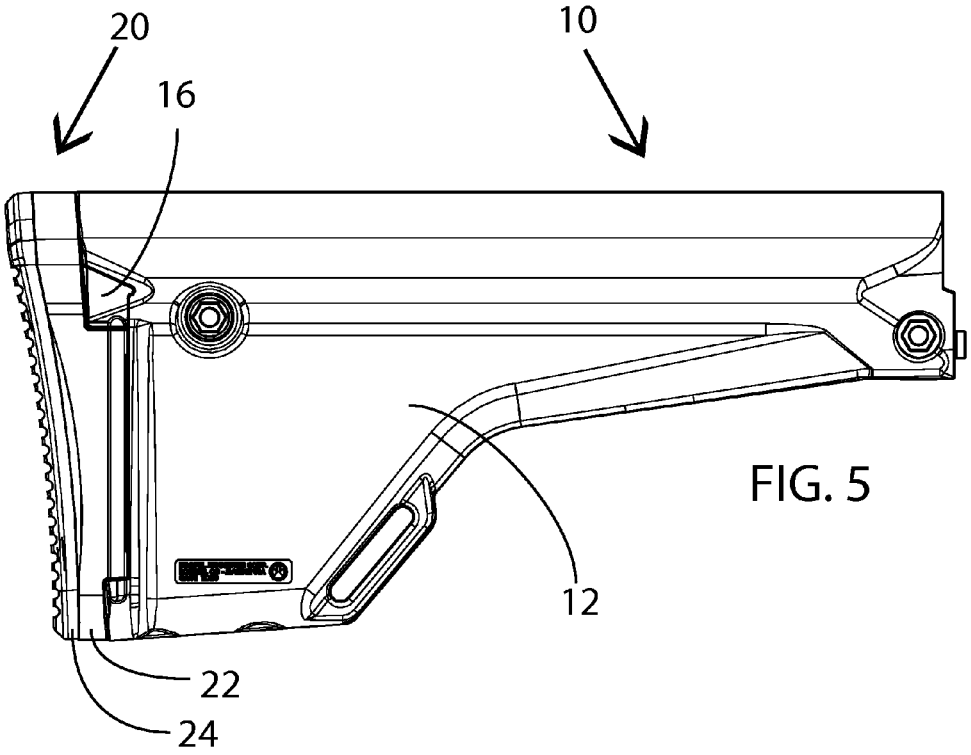
FIG. 5 is a left elevation of the fixed stock of FIG. 3.

It is important to note that the preferred interface of the cam plug 16 with the rear edge 14 of the stock 10 is best shown in FIGS. 4 and 5 where a triangular portion of cam plug 16 is visible on both sides of the stock 10. Positioning an interface in this area, behind the receiver extension tube and as broad as possible across the stock body, adds stability and strength to the stock and its connection to the firearm. It is entirely conceivable to not have the cam plug 16 interface with the rear edge 14, and instead be contained within the chamber of the body 12 of the stock, but this is not preferred. Generally, the greater the external interface, the more stable the interface. This must, however, be balanced with the cost to manufacture the components. To this end, a simple interface, as illustrated in the figures, generally a wedge shape on either side of and behind the receiver extension tube and across the stock body 12 will suffice for securement purposes. Having the cam plug 16 interface with the edge 14 also allows the cam plug 16 to be easily used in assembling the door 20 to the stock body 12, as described below.

Figure 6:
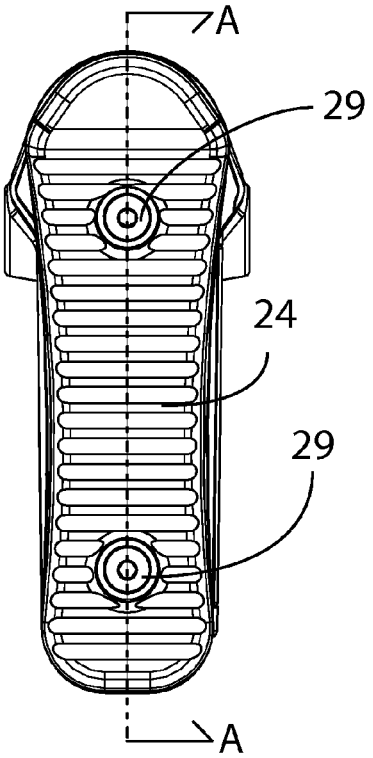
FIG. 6 is a rear elevation of the fixed stock of FIG. 3.
Figure 7:
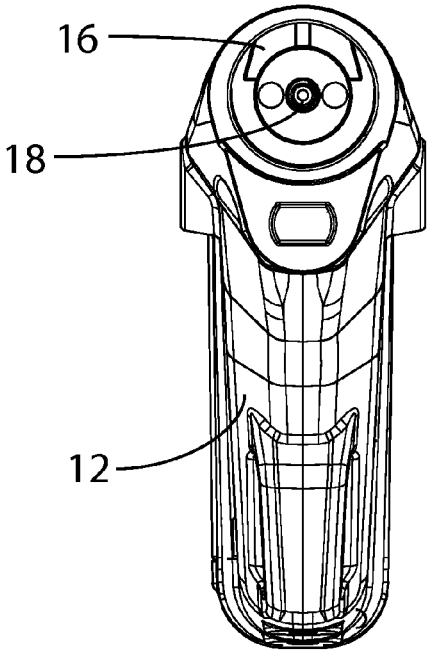
FIG. 7 is a front elevation of the fixed stock of FIG. 3.
Figure 8:
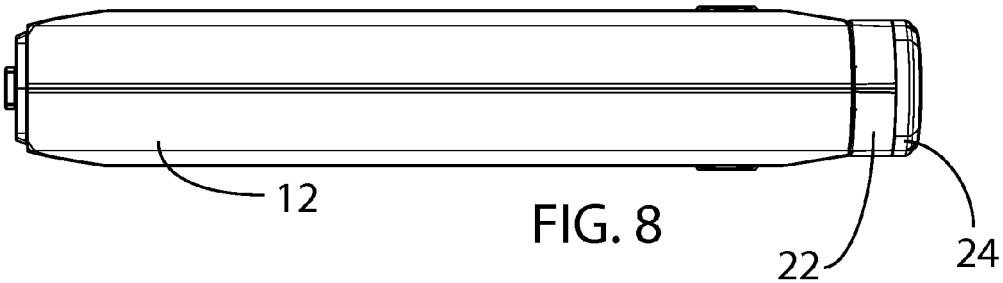
FIG. 8 is a top plan view of the fixed stock of FIG. 3.
Figure 9:
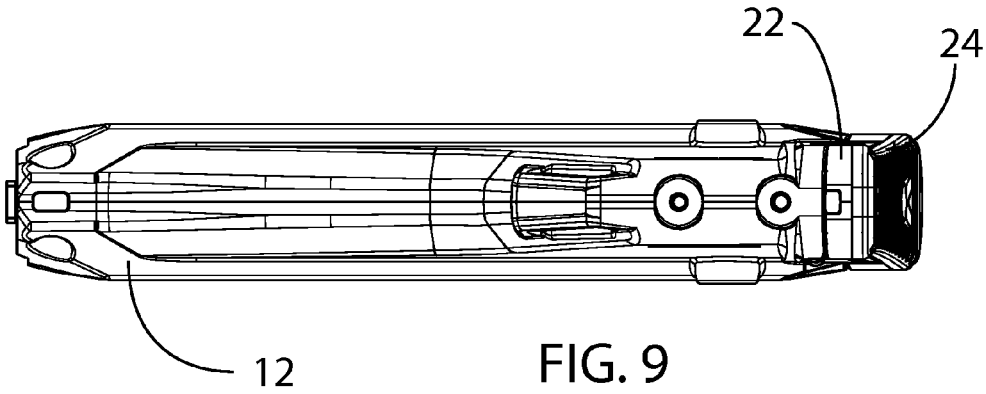
FIG. 9 is a bottom plan view of the fixed stock of FIG. 3.
Figure 10:
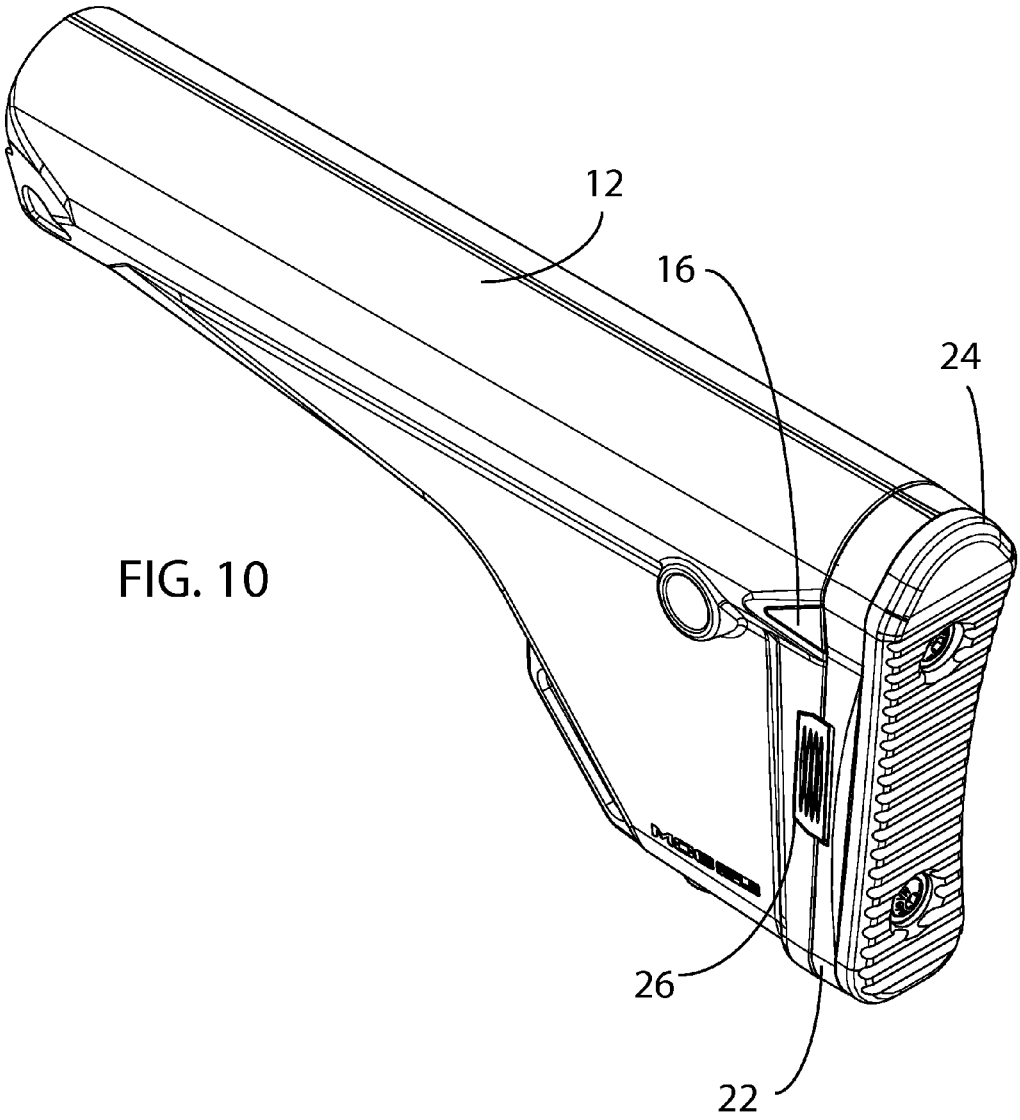
FIG. 10 is a rear perspective view of the fixed stock of FIG. 3.
Figure 11:
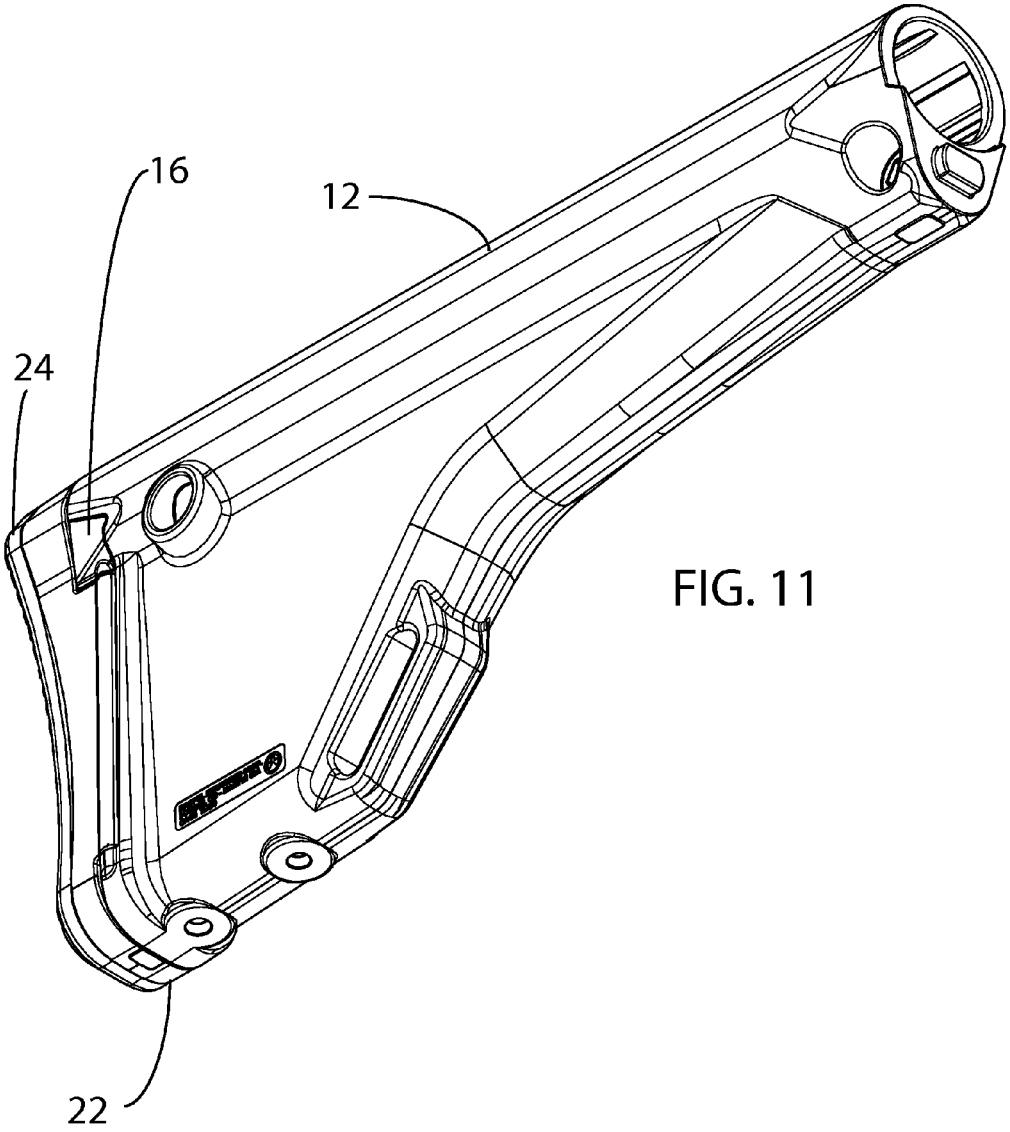
FIG. 11 is a front perspective view of the fixed stock of FIG. 3.
Figure 12:
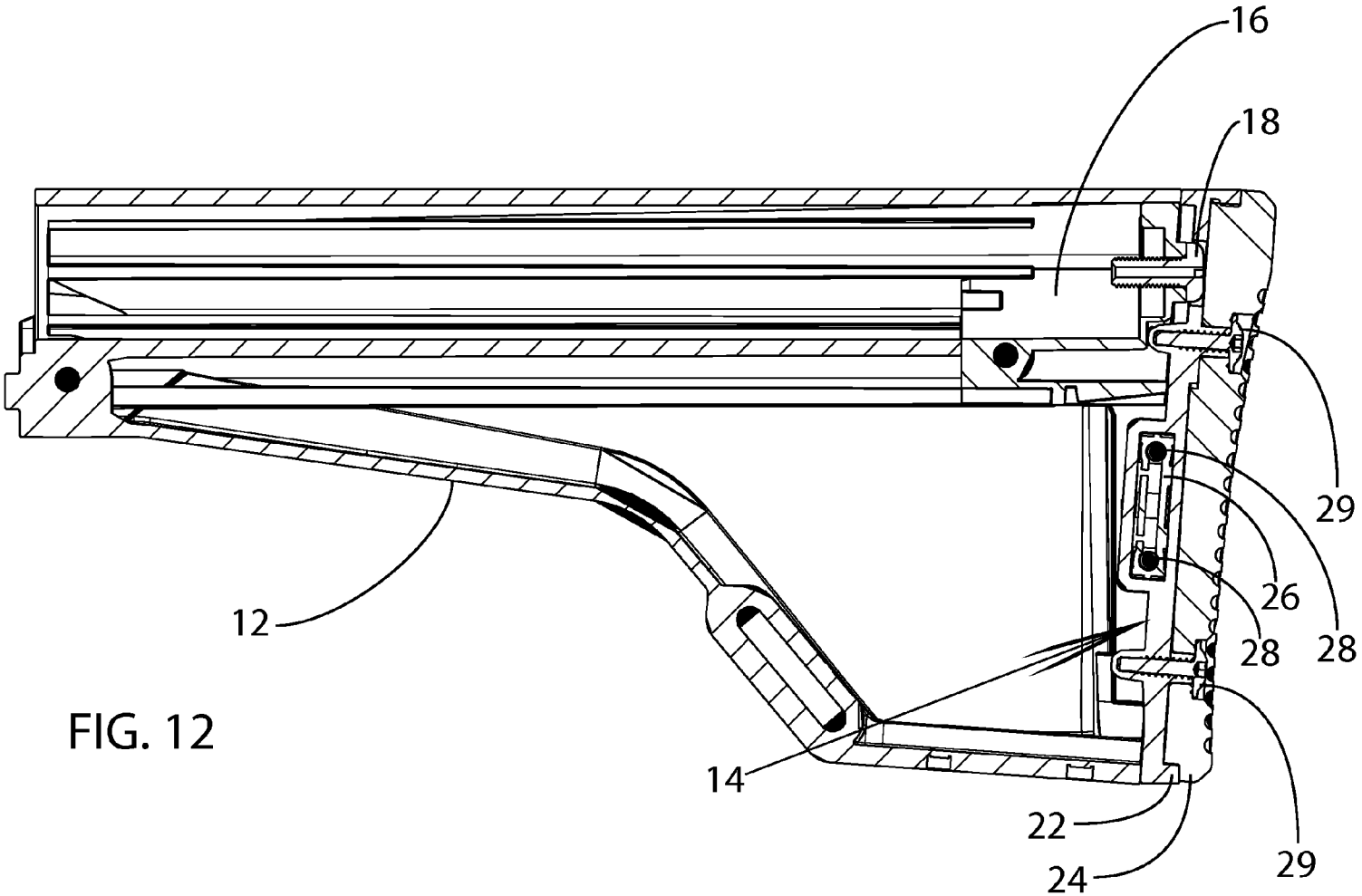
FIG. 12 is a sectional view of the fixed stock of FIG. 6, taken along line A-A.
Figure 13:
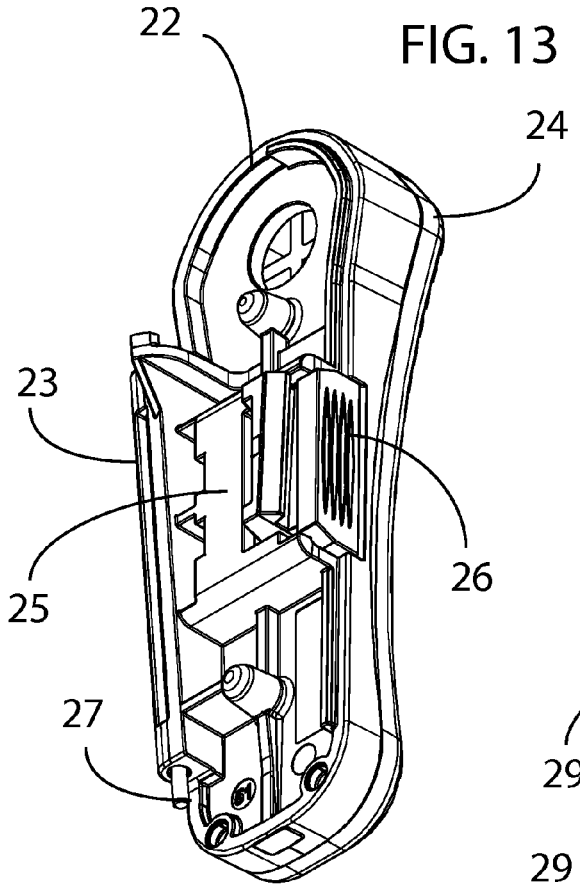
FIG. 13 is a front perspective view of the door assembly utilized on the fixed stock of FIG. 3.
Figure 14:
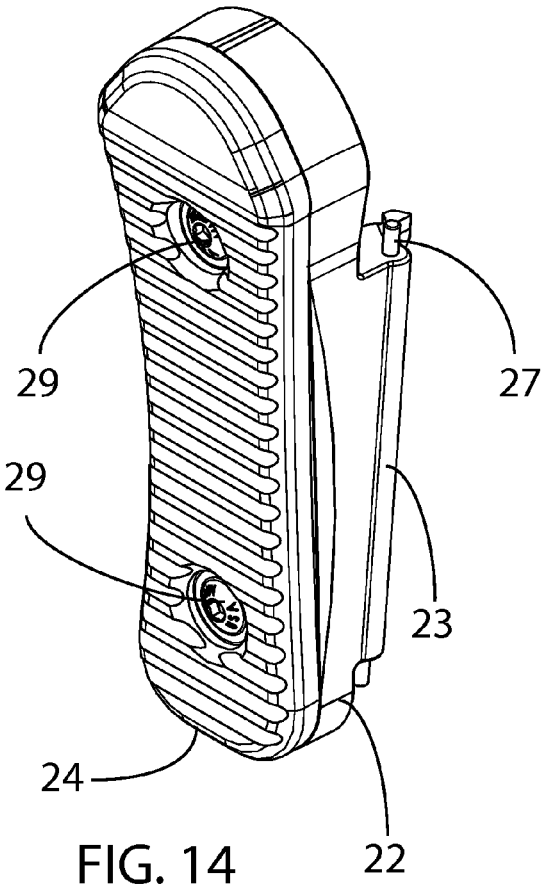
FIG. 14 is a rear perspective view of the door assembly of FIG. 13.
Figure 15:
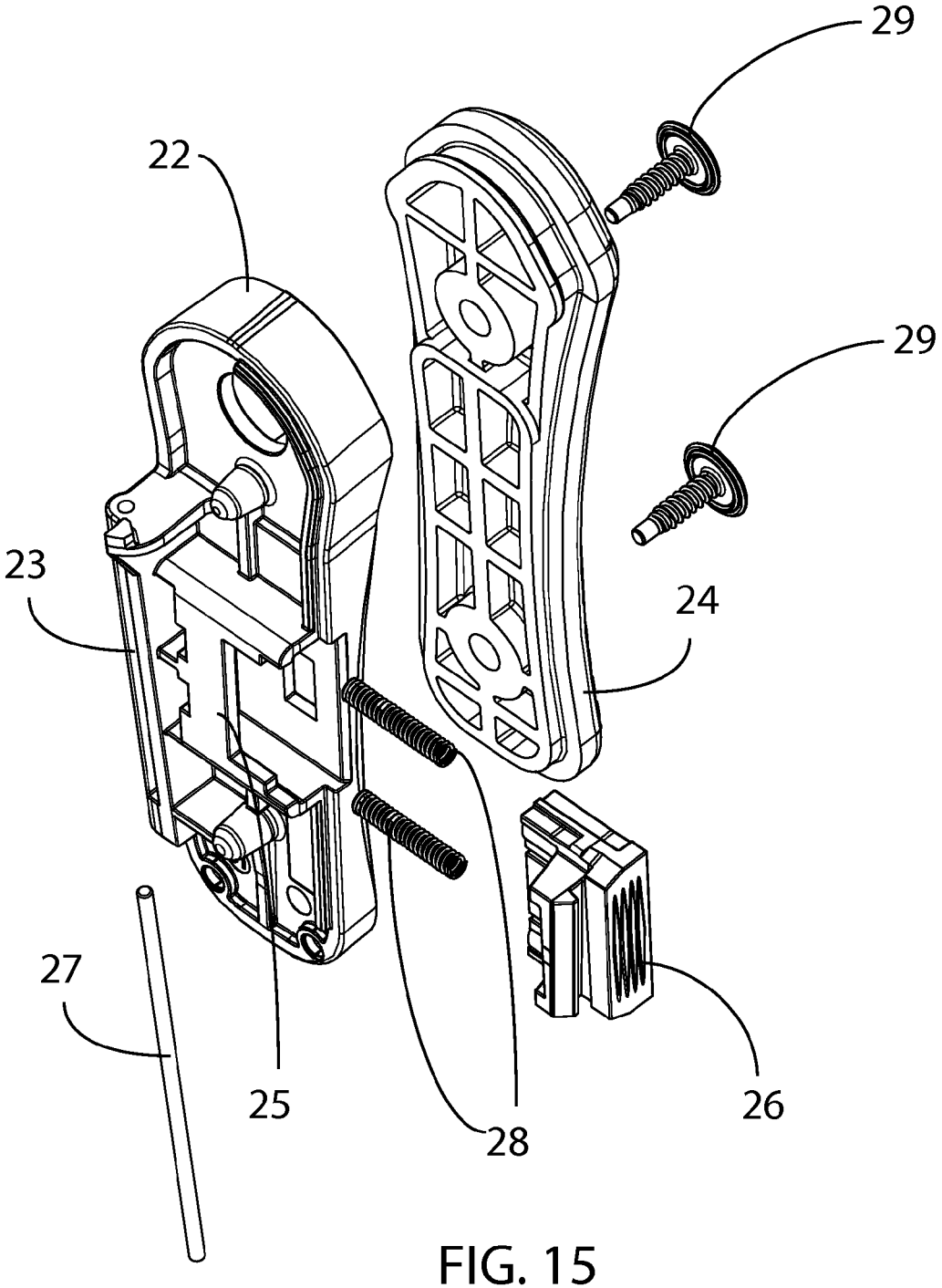
FIG. 15 is an exploded view of the door assembly of FIG. 13.

Finally, a door 20 is attached to one side of the rear edge 14 and the cam plug 16. Door 20 is connected to the stock 10 by a hinge assembly and selectively held in place by latch 26. While any construction for the door may suffice, it is preferred the door 20 be a two part construction comprising a door chassis 22 and a rear butt pad 24, as shown in FIGS. 4-11. A set of screws 29 then secures the butt pad 24 to the door chassis 22 (FIG. 6). This allows customization of the butt pad 24. Internal construction of the door 20 is shown in FIGS. 12-15. As can be seen, the latch 26 is biased in a closed position by two springs 28 and resides in a latch cage 25 on the door chassis 22. It is positioned to project from one side of the door chassis 22 and engage a portion of the rear edge 14 of the stock 10 to selectively secure the door 20. A hinge structure 23 is provided to the other side of the door chassis 22 and houses a hinge rod 27. Hinge rod 27 is slightly larger than hinge structure 23 and nests its ends in the rear edge 14 of the stock 10 and in the cam plug 16 (FIG. 11). To assemble the stock, the cam plug 16 is mostly inserted into the stock body 12 and the hinge rod 27 into the hinge structure. Ends of hinge rod 27 are inserted into provided holes in the stock body 12 and the cam plug 16. The cam plug 16 is then fully inserted into the stock body 12 and secured by bolt 18 to the receiver tube 8 or other stock mounting body, thus securing the door in place 20. In use then, the latch 26 is disengaged and the door opened to access the internal compartment of the stock 10, which includes not only general storage, but also the cam plug 16 for installation and removal of the stock 10. The internal structure of the stock may also include specialized areas for storage of common elements, like batteries, or modules which may be constructed to fit within the compartment.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A firearm butt stock for a firearm, the firearm comprising a receiver and receiver extension tube, the butt stock comprising:

a stock body slidable upon the receiver extension tube, the stock body further comprising forward and a rearward ends, the rearward end terminating in a circumferential flange that at least partially defines a rear compartment and a hind edge;

a bolt capable of threadingly interfacing with the receiver extension tube;

a cam plug, through which the bolt may pass in order to interface with the receiver extension tube; and a door hingedly connected to one side of the hind edge and the cam plug and selectively latched to a portion of the hind edge opposite where the door is hingedly connected;

wherein the cam plug resides within the rear compartment, is held in position by the bolt, and thereby cams the stock body against the receiver.

2. The firearm butt stock of claim 1, the cam plug interfacing at least partially with the hind edge of the stock body.

* * * * *